US011781754B2

(12) United States Patent
Wu et al.

(10) Patent No.: US 11,781,754 B2
(45) Date of Patent: Oct. 10, 2023

(54) ASSEMBLY FOR CONTROLLING DETONATION WAVE MODE OF ROTATING DETONATION COMBUSTION CHAMBER

(71) Applicant: PLA AIR FORCE ENGINEERING UNIVERSITY, Shaanxi (CN)

(72) Inventors: Yun Wu, Shaanxi (CN); Feilong Song, Shaanxi (CN); Huimin Song, Shaanxi (CN); Min Jia, Shaanxi (CN); Shanguang Guo, Shaanxi (CN); Xin Chen, Shaanxi (CN); Di Jin, Shaanxi (CN); Zhao Yang, Shaanxi (CN)

(73) Assignee: PLA AIR FORCE ENGINEERING UNIVERSITY, Shaanxi (CN)

( * ) Notice: Subject to any disclaimer, the term of this patent is extended or adjusted under 35 U.S.C. 154(b) by 0 days.

(21) Appl. No.: 17/847,890

(22) Filed: Jun. 23, 2022

(65) Prior Publication Data

US 2022/0412564 A1 Dec. 29, 2022

(30) Foreign Application Priority Data

Jun. 26, 2021 (CN) ..... 202110715241.4

(51) Int. Cl.
*F23R 7/00* (2006.01)

(52) U.S. Cl.
CPC ..... *F23R 7/00* (2013.01)

(58) Field of Classification Search
CPC ..... F02C 5/11; F02K 7/067; F23R 7/00
See application file for complete search history.

(56) References Cited

U.S. PATENT DOCUMENTS

| | | | | |
|---|---|---|---|---|
| 5,265,636 | A * | 11/1993 | Reed | F15C 1/146 137/833 |
| 9,599,065 | B2 * | 3/2017 | Falempin | F23R 7/00 |
| 2021/0108801 | A1 * | 4/2021 | Singh | F23R 7/00 |
| 2022/0195963 | A1 * | 6/2022 | Liu | F23R 7/00 |

FOREIGN PATENT DOCUMENTS

| | | |
|---|---|---|
| CN | 109737457 A | 5/2019 |
| CN | 112879159 A | 6/2021 |

OTHER PUBLICATIONS

CN 112879159 translation downloaded Mar. 16, 2023 (Year: 2023).*
First Office Action cited in CN202110715241.4 dated Jun. 9, 2022, 13 pages.

* cited by examiner

*Primary Examiner* — Ted Kim
(74) *Attorney, Agent, or Firm* — COOPER LEGAL GROUP, LLC

(57) ABSTRACT

The application relates to an assembly for controlling detonation wave mode of a rotating detonation combustion chamber, which includes an inner barrel, an outer plate and at least one sectoral direction-changing block. The outer plate is sleeved outside the inner barrel. An annular cavity is formed between the outer plate and the inner barrel. At least one groove is arranged on one side of the outer plate close to the inner barrel. The groove wall comprises an arc edge and a straight edge. The groove is connected with the annular cavity. The sectoral direction-changing blocks are arranged in the grooves in one-to-one correspondence. An arc edge of the sectoral direction-changing block is positioned far away from the inner barrel.

1 Claim, 3 Drawing Sheets

ASSEMBLY FOR CONTROLLING DETONATION WAVE MODE OF ROTATING DETONATION COMBUSTION CHAMBER

CROSS-REFERENCE TO RELATED APPLICATION

The present application is based on and claims the priority benefits of China application No. 202110715241.4, filed on Jun. 26, 2021. The entirety of China application No. 202110715241.4 is hereby incorporated by reference herein and made a part of this specification.

TECHNICAL FIELD

The present application relates to the field of aeroengines, and in particular, to an assembly for controlling detonation wave mode of a rotating detonation combustion chamber.

BACKGROUND ART

A detonation wave is composed of a leading shock wave and a reaction zone immediately following it. The leading shock wave compresses and ignites a reactant to release a large amount of energy. Detonation combustion has the advantages of high heat release intensity per unit time, self pressurization, high combustion efficiency and low pollutant emission. At present, a propulsion technology based on detonation combustion is an important development trend of space technology in the future.

A mode of a detonation wave refers to s rotating state of the detonation wave in the combustion chamber. An ideal mode of the detonation wave is that one or more detonation waves rotate in a certain direction in an annular combustion chamber. However, the mode of the detonation wave is very complex. A reverse rotating secondary wave will be derived during the movement of a detonation wave rotating in a certain direction, and the secondary wave will gradually be evolved into a strong detonation wave, which will collide with the original detonation wave, that is, double wave collision occurs. The collision will reduce the effective total pressure gain of the detonation wave.

SUMMARY

In view of this, the present application provides an assembly for controlling detonation wave mode of rotating detonation combustion chamber to improve the effective total pressure gain of a detonation wave.

An assembly for controlling detonation wave mode of a rotating detonation combustion chamber provided by the application adopts the following technical solution.

An assembly for controlling detonation wave mode of a rotating detonation combustion chamber includes an inner barrel, an outer plate and at least one sectoral direction-changing block. The outer plate is sleeved outside the inner barrel. An annular cavity is formed between the outer plate and the inner barrel. At least one groove is arranged on one side of the outer plate close to the inner barrel. The groove wall comprises an arc edge and a straight edge. The groove is connected with the annular cavity. The sectoral direction-changing blocks are arranged in the grooves in one-to-one correspondence. An arc edge of the sectoral direction-changing block is positioned far away from the inner barrel. The arc edge of the groove is conformal with the arc edge of the sectoral direction-changing block, the sectoral direction-changing block is obliquely arranged relative to the straight edge, an arc direction-changing channel is formed between the arc edge of the groove and the arc edge of the sectoral direction-changing block, and a straight inlet channel is formed between the side wall of the sectoral direction-changing block close to the straight edge and the straight edge.

In the above technical solution, the straight edge and arc edge of the groove and the sectoral direction-changing block form a structure similar to a Tesla valve. The detonation wave rotates around the inner barrel in the annular cavity. When the detonation wave derives a secondary wave rotating reversely and the detonation wave evolved from the secondary wave rotates into the straight inlet channel, due to unidirectional conductivity of a Tesla valve, the secondary wave enters the straight inlet channel and the arc direction-changing channel where it is subjected to direction changing. Thereby, the secondary wave has the same rotation direction as the original detonation wave, which effectively reduces the collision of detonation waves, and thus improves the effective detonation pressurization of detonation waves.

Optionally, an included angle between a side wall of the sectoral direction-changing block close to the straight edge and the straight edge is 30°-45°.

In the above technical solution, the secondary wave can be better guided and more secondary waves can enter the straight inlet channel and have a direction change via the direction-changing channel.

Optionally, the sectoral direction-changing block has a central angle of 30°-45°.

In the above technical solution, when the sectoral direction-changing block has a central angle of 30°-45°, the straight inlet channel and arc direction-changing channel have better direction changing effect.

To sum up, this application includes the following beneficial technical effects:

The straight edge and arc edge of the groove and the sectoral direction-changing block form a structure similar to a Tesla valve. The detonation wave rotates around the inner barrel in the annular cavity. When the detonation wave derives a secondary wave rotating reversely and the detonation wave evolved from the secondary wave rotates into the straight inlet channel, due to unidirectional conductivity of a Tesla valve, the secondary wave enters the straight inlet channel and the arc direction-changing channel where it is subjected to direction changing. Thereby, the secondary wave has the same rotation direction as the original detonation wave, which effectively reduces the collision of detonation waves, and thus improves the effective detonation pressurization of detonation waves.

DETAILED DESCRIPTION

The present application will be described in further detail below with reference to FIGS. 1-3.

An ideal mode of a detonation wave is that one or more detonation waves propagate in a same direction in an annular combustion chamber, but actually, the mode of the detonation wave is very complex and difficult to control. A reversely rotating secondary wave will be derived in the propagation process of the detonation wave, and will gradually increase during propagation in the annular combustion chamber and collide with the original detonation wave propagating in a reverse direction, that is, double wave collision occurs. Once the two waves collide with each other, the two waves will become a transmitted shock wave respectively and continue to rotate in the annular combustion chamber since at both sides of the collision point are combustion products. However, the transmitted shock wave at this time is no longer a detonation wave, which means that, during the rotating of the detonation wave for one circle in a circumferential direction does not provide an effective detonation gain along a whole ring.

After the transmission of the transmitted shock wave, the shock wave continues to rotate in the annular combustion chamber and gradually evolves into a new detonation wave. The new detonation wave repeats the movement process of the original detonation wave, that is, the detonation wave repeats a process of annihilating and then developing into a new detonation, so that denoting and annihilating occur at the same time, resulting in an extremely low effective detonation pressurization.

In embodiments of the present application, an assembly for controlling detonation wave mode of a rotating detonation combustion chamber is disclosed.

Embodiment 1

Figure 1:
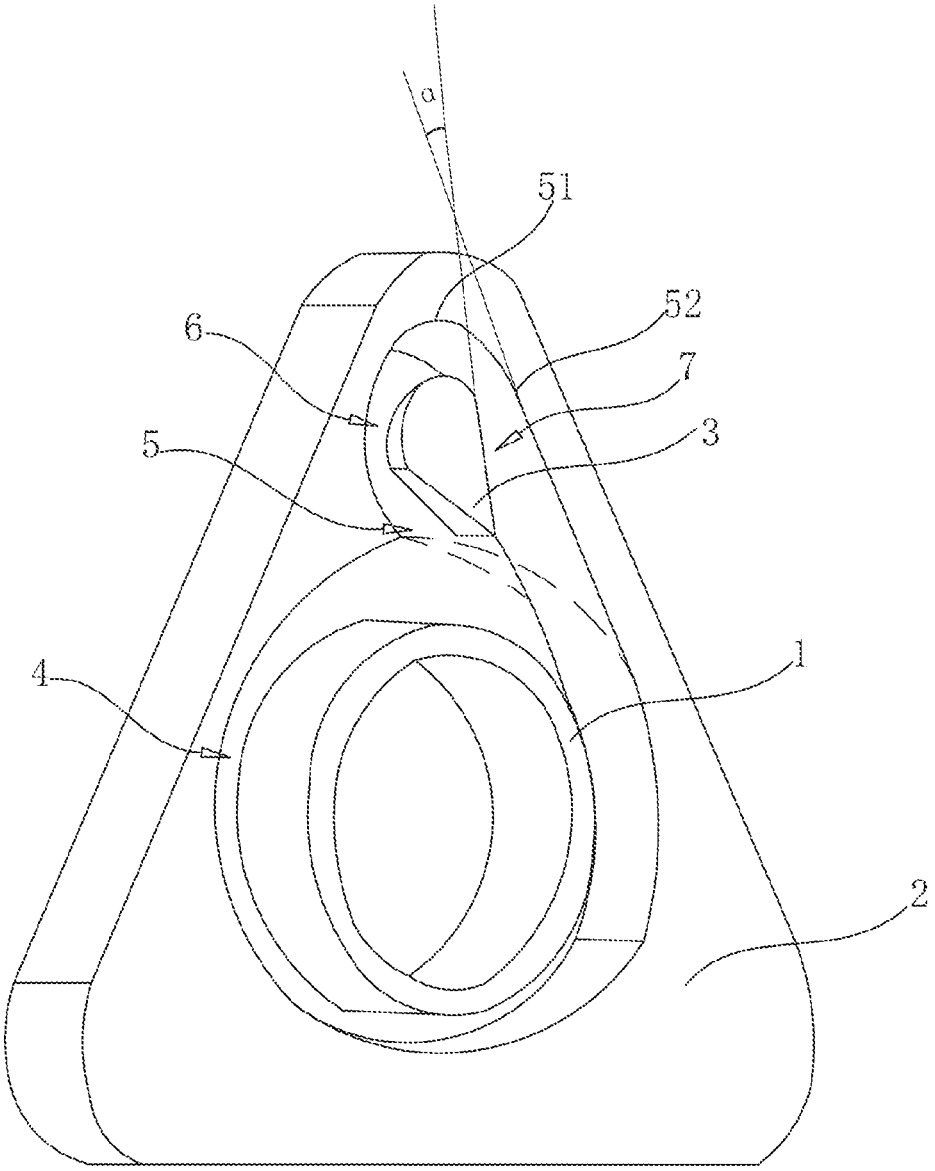
FIG. 1 is a schematic overall structural diagram of an assembly for controlling detonation wave mode of a rotating detonation combustion chamber according to an embodiment of the present application.

As shown in FIG. 1, an assembly for controlling detonation wave mode of a rotating detonation combustion chamber includes an inner barrel 1, an outer plate 2 and at least one sectoral direction-changing block 3. The outer plate 2 is sleeved outside the inner barrel 1, with an annular cavity 4 formed between the outer plate 2 and the inner barrel 1, and the sectoral direction-changing block 3 has a center angle of 30°-45°.

Figure 2:
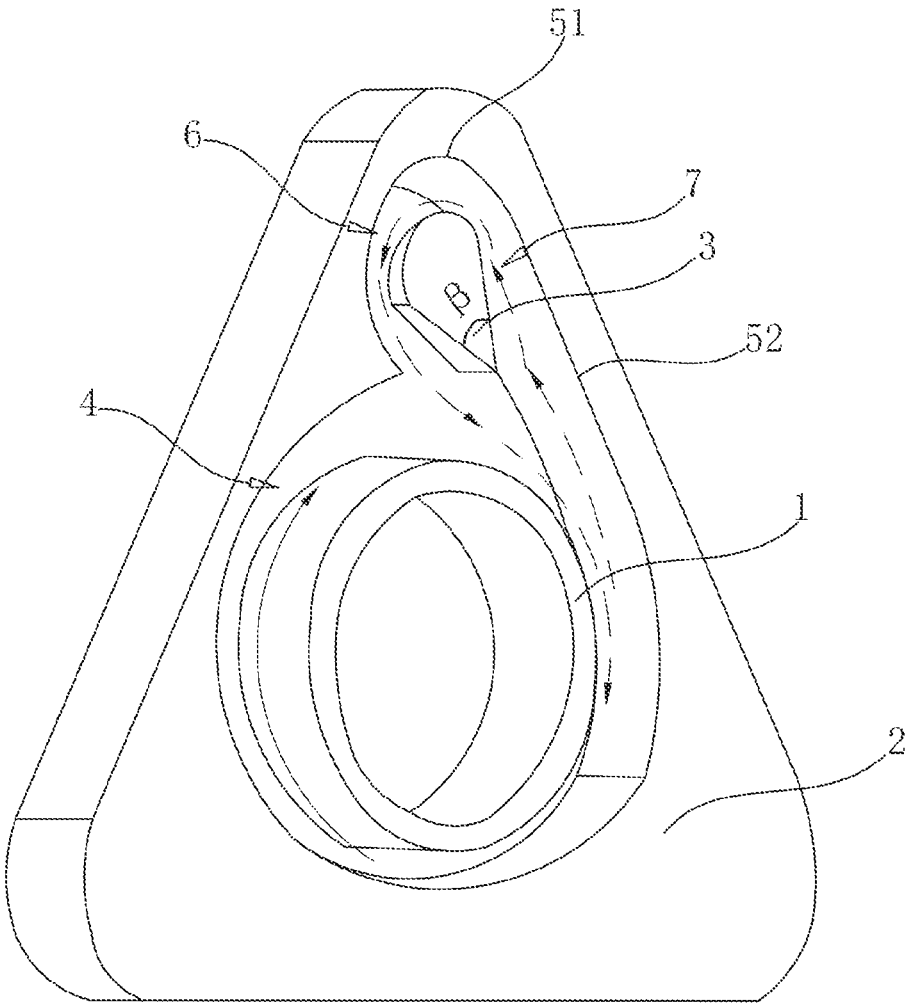
FIG. 2 is a schematic overall structural diagram of FIG. 1 with arrows indicating a movement direction of a detonation wave and a secondary wave.

As shown in FIG. 1 and FIG. 2, at least one groove 5 is arranged on a side of the outer plate 2 close to the inner barrel 1, and a wall of the groove 5 includes an arc edge 51 and a straight edge 52. The groove 5 is communicated with the annular cavity 4. A plurality of sectoral direction-changing blocks 3 are provided in the grooves 5 in one-to-one correspondence. An arc edge of the sectoral direction-changing block 3 is positioned far away from the inner barrel 1, the arc edge 51 is conformal with the arc edge of the sectoral direction-changing block 3, and the sectoral direction-changing block 3 is arranged obliquely towards the straight edge 52. An included angle between a side wall of the sectoral direction-changing block 3 close to the straight edge 52 and the straight edge 52 is 30°-45°. An arc direction-changing channel 6 is formed between the arc edge 51 and the arc edge of the sectoral direction-changing block 3, and an straight inlet channel 7 is formed between an side wall of the sectoral direction-changing block 3 close to the straight edge 52 and the straight edge 52. In some embodiments, there is one sectoral direction-changing block 3 and one grooves 5.

As shown in FIG. 1 and FIG. 2, the straight edge 52 and the arc edge 51 of the groove 5 and the sectoral direction-changing block 3 form a structure similar to a Tesla valve. A detonation wave rotates around the inner barrel in the annular cavity 4. When the detonation wave derives a secondary wave opposite to its own rotation direction, a detonation wave evolved from the secondary wave rotates to the straight inlet channel 7. Due to unidirectional conductivity of the Tesla valve, the secondary wave is subjected to direction change by passing through the straight inlet channel 7 and the arc direction-changing channel 6 in turn, as shown in the figures, in which a solid line with an arrow represents a movement direction of the original detonation wave, and a dotted line with an arrow represents a movement direction of the detonation wave evolved from the secondary wave. The secondary wave after direction changing has a same rotation direction as the original detonation wave, which effectively reduces a collision between detonation waves and enhances effective detonation pressurization of detonation waves.

An implementation principle of Embodiment 1 in the present application is as follows. A structure similar to a Tesla valve is formed by the straight edge 52 and the arc edge 51 of the groove 5 and the sectoral direction-changing block 3. After the detonation wave evolved from the secondary wave rotates to the straight inlet channel 7, it enters the arc direction-changing channel 6 along the straight inlet channel 7, where its direction is changed by the arc direction-changing channel 6, so that the detonation wave after direction changing has the same rotation direction as the original detonation wave, thereby reducing the collision between detonation waves, and enhancing the effective detonation pressurization of the detonation wave.

Embodiment 2

Figure 3:
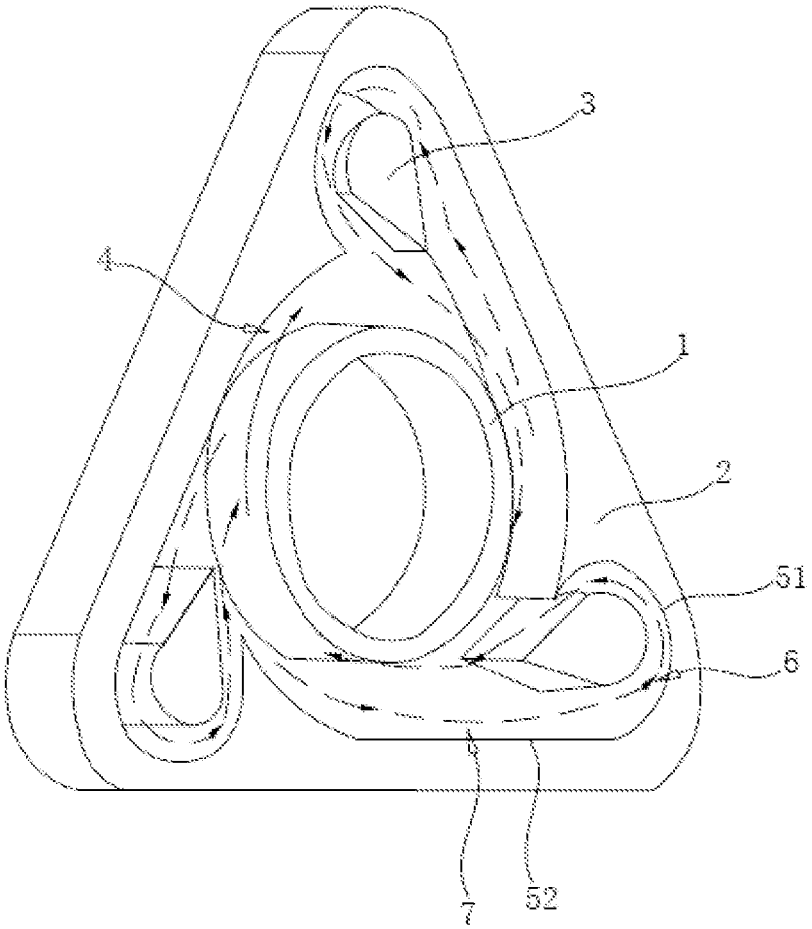
FIG. 3 is a schematic overall structural diagram of an assembly for controlling detonation wave mode of a rotating detonation combustion chamber in another embodiment of the present application.

Referring to FIG. 3, the difference of this embodiment from Embodiment 1 is that, in this embodiment, there are three sectoral direction-changing blocks 3 and three grooves 5, which are arranged on a periphery of the annular cavity 4 at intervals.

An implementation principle of Embodiment 2 in the present application is the same as that of Embodiment 1. By increasing the number of sectoral direction-changing blocks 3 and grooves 5, the positions where the direction of the detonation wave evolved from the secondary wave can be changed is increased. In this figure, a solid line with an arrow represents a movement direction of an original detonation wave, and a dotted line with an arrow represents a movement direction of the detonation wave evolved from the secondary wave. In this embodiment, the collision between an opposite detonation wave and the original detonation wave can be further reduced. Thus, the effective detonation pressurization of the detonation wave can be further improved.

The above are the preferred embodiments of the present application, which are not intended to limit the protection scope of the present application. Therefore, all equivalent changes made according to the structure, shape and principle of the present application should be covered within the protection scope of the present application.

What is claimed is:

1. An assembly for controlling detonation wave mode of a rotating detonation combustion chamber, comprising an inner barrel, an outer plate and at least one sectoral direction-changing block, wherein the outer plate is sleeved outside the inner barrel, an annular cavity having an perimeter is formed between the outer plate and the inner barrel, at least one groove is arranged on a side of the outer plate close to the inner barrel, a groove wall of the at least one groove comprises an arc edge and a straight edge, the straight edge being inclined and connected to the perimeter of the annular cavity, the at least one groove is connected with the annular cavity, the at least one sectoral direction-changing block is arranged in the at least one groove in one-to-one correspondence, the arc edge of the at least one groove is conformal with an arc edge of the at least one sectoral direction-changing block, the at least one sectoral direction-changing block is obliquely arranged relative to the straight edge, an included angle between the straight edge and a side wall of the at least one sectoral direction-changing block close to and facing the straight edge is 30-45°, an arc direction-changing channel is defined between the arc edge of the at least one groove and the arc edge of the at least one sectoral direction-changing block, a straight inlet channel is defined between the straight edge and the side wall of the at least one sectoral direction-changing block close to and facing the straight edge, where the rotation detonation combustion chamber has a predetermined rotating detonation wave direction in the annular cavity, when the rotating detonation wave derives a secondary wave rotating reversely relative to the predetermined rotating detonation wave direction, the secondary wave enters the straight inlet channel and the arc direction-changing channel where the secondary wave is subjected to direction changing, the secondary wave after the direction changing has a same rotation direction as the predetermined rotating detonation wave direction and exits the groove to rotate with the predetermined rotating detonation wave direction in the annular cavity, and the at least one sectoral direction-changing block has a central angle of 30-45°.

* * * * *